United States Patent [19]

Lillo

[11] Patent Number: 4,577,616

[45] Date of Patent: Mar. 25, 1986

[54] WOOD BURNING FURNACE

[76] Inventor: Arnold D. Lillo, Rte. 1, Box 111, Good Thunder, Minn. 56037

[21] Appl. No.: 679,644

[22] Filed: Dec. 10, 1984

[51] Int. Cl.[4] ..... F24H 3/02

[52] U.S. Cl. ..... 126/110 R; 126/61; 126/67; 126/99 R

[58] Field of Search ..... 126/61, 63, 66, 67, 126/69, 99 R, 110 R, 110 E

[56] References Cited

U.S. PATENT DOCUMENTS 4,232,651 11/1980 Lind ..... 126/110 E 4,377,153 3/1983 Flagg ..... 126/61

*Primary Examiner*—Carroll B. Dority, Jr.

*Attorney, Agent, or Firm*—Williamson, Bains, Moore & Hansen

[57] ABSTRACT

A wood burning furnace, positionable exterior to a home or trailer utilizes an improved heat exchanger with a chimney stack extending downwardly into the heat exchanger chamber to prolong the time interval in which smoke stays in the heat exchanger. A creosote removal blade is slidably mounted within the chamber to scrape creosote deposits from the inner periphery of the chamber and to direct it downwardly into the fire box for subsequent burning.

9 Claims, 2 Drawing Figures

WOOD BURNING FURNACE

BACKGROUND OF THE INVENTION

The invention relates to the field of wood burning furnaces and comprises a high efficiency furnace having an aperture for the removal of accumulated creosote from the heat exchanger.

With the rising cost of operating electric and gas fired furnaces has come an increased interest in wood burning furnaces and an effort to utilize firewood when such wood is inexpensive and available. Rising demand for wood burning furnaces has encouraged efforts to make the wood furnace more energy efficient and also more adaptable to existing buildings having already installed gas fired or electric heating systems. In addition, there are a growing number of mobile homes and trailers, particularly in outlying areas, which would utilize wood burning furnaces if the furnaces could be safely and effectively combined with the existing gas fire furnaces typically used with such trailers and mobile homes. In situations where the wood furnace is to be used in combination with an existing home heating system, it is helpful to be able to position the wood furnace outside the home or trailer. Such external positioning eliminates indoor smoke odors as well as eliminating the need to move sometimes dirty firewood into the home and to carry the ashes outdoors. In some geographic areas, building code restrictions can also be less demanding for an externally positioned wood furnace.

In order to reduce the amount of wood consumed by such a furnace and to prolong the burning time with a given quantity of wood, more efficient furnaces with improved heat exchangers are desirable. Typically such efficiency is gained by constructing the heat exchanger to extract more heat from the hot air and smoke passing through the exchanger before exhausting the air and smoke from the furnace chimney. Efficiency can be noticably increased by having the heat exchanger be a tightly closed doorless chamber with minimal external openings through which heat loss can occur. It has been found, however, that as the heat exchanger successfully removes more and more heat from the smoke within it, that the amount of creosote deposited from the smoke onto the heat exchanger increases. Such deposits of creosote can be undesirable because they tend to insulate the heat exchanger walls from the smoke and thereby progressively reduce later heat transfer, and additionally, such creosote can eventually create a fire hazard, producing secondary fires in the exchanger and chimney. Accordingly, it is desirable to not only increase the efficiency of the heat exchanger but to also provide a means to intermittently purge the interior of the closed heat exchanger of such creosote deposits and to dispose of the creosote. The present invention provides an improved heat exchanger of high efficiency and a means for effectively removing the creosote from the heat exchanger.

SUMMARY OF THE INVENTION

The invention comprises an improved wood furnace designed to be positioned external to a home or trailer and provided with an improved, highly efficient heat exchanger which can be easily purged of accumulated creosote.

The wood furnace is provided with an upright frame which carries a conventional fire box on top of which a heat exchanger is mounted. The heat exchanger is connected with the fire box by a pair of upright columns which supply smoke from fire box to heat exchanger.

The heat exchanger has a generally flat top and bottom interconnected by vertical and angled side walls so that creosote scraped from the side walls will slide downwardly and inwardly to the bottom of the heat exchanger.

A scraper blade having an outer periphery generally similar to the cross section of the heat exchanger chamber is slidably mounted for movement from the rear wall to the front wall of the chamber and is provided with a pair of parallel rods which extend forwardly through the front wall of the heat exchanger and are accessible to an operator so as to permit scraping movement of the blade within the heat exchanger to remove the creosote deposits. Such deposits drop downwardly to the bottom of the heat exchanger and are forced into the upright columns for subsequent movement into and burning within the fire box.

The lower end of the chimney stock extends downwardly into the heat exchanger to delay the escape of hot air and smoke from the exchanger and to thereby increase the heat transferred to the exchanger.

These and other objects and advantages of the invention will appear more fully from the following description made in conjunction with the accompanying drawings wherein like reference characters refer to the same or similar parts throughout the several views.

DESCRIPTION OF THE PREFERRED EMBODIMENT

Figure 1:
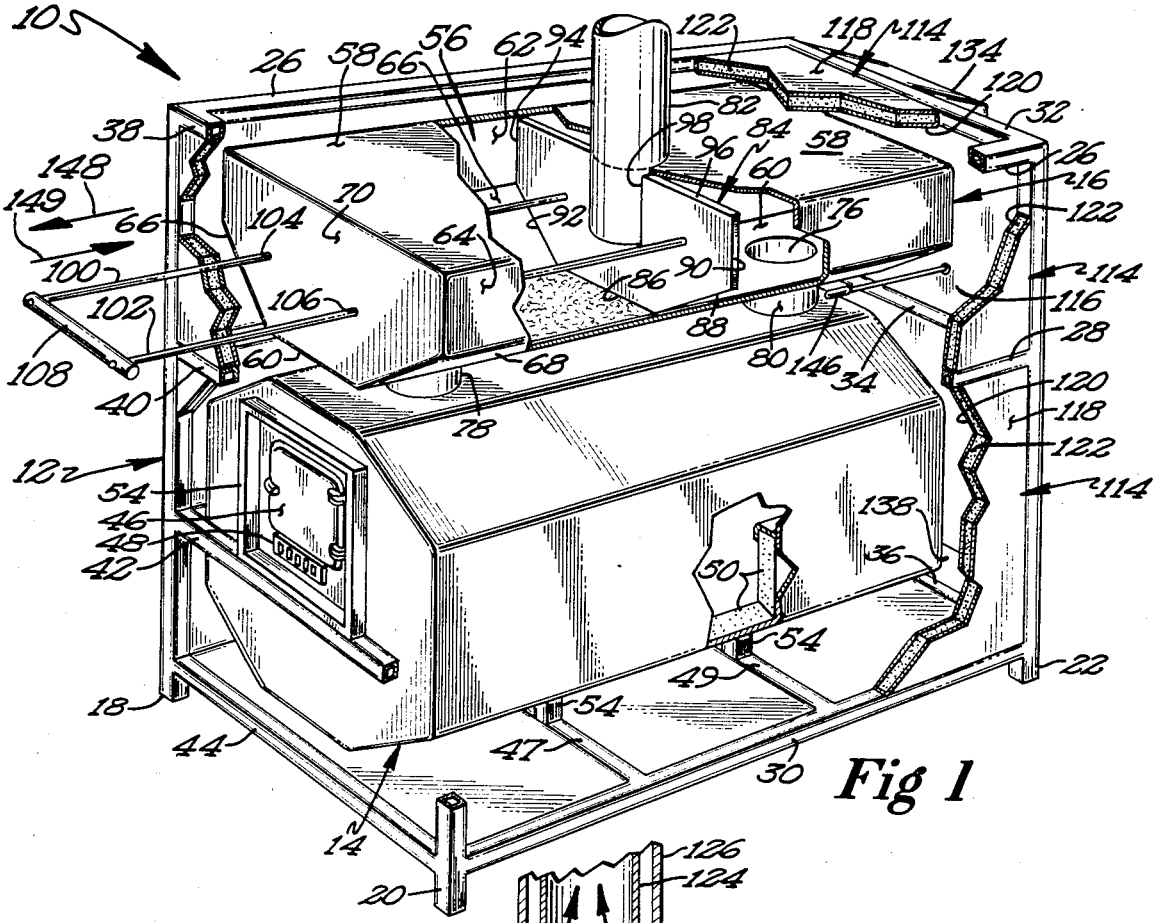
FIG. 1 is a front perspective partially exploded and cut-away view of a wood burning furnace embodying the invention.
Figure 2:
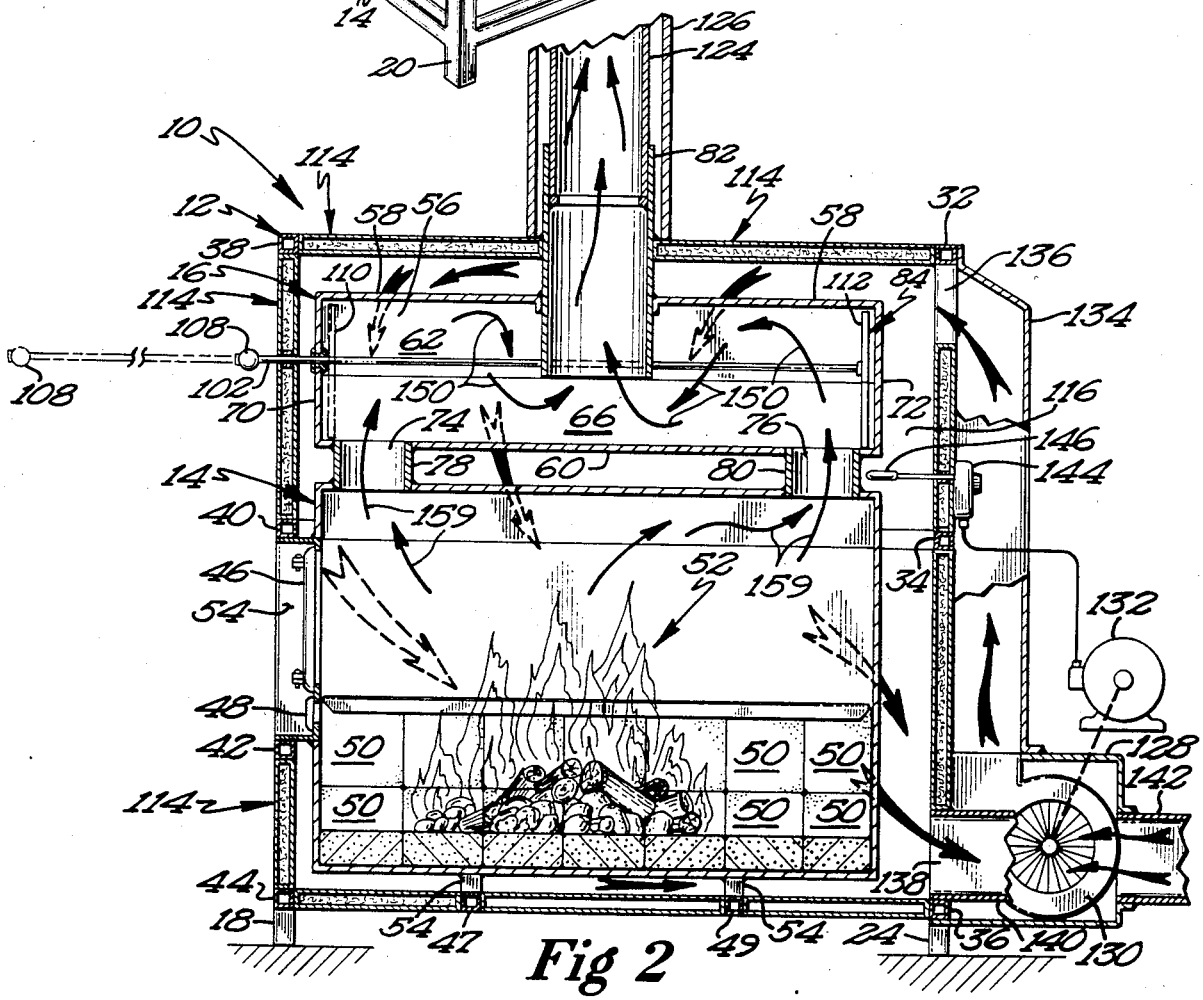
FIG. 2 is a cross sectional side elevation view of the furnace of FIG. 1 and showing the creosote removal blade in alternative positions.

Referring now to FIGS. 1 and 2, an improved hot air wood burning furnace 10, embodying the invention, has an upright frame 12 which surrounds internal fire box 14 and heat exchanger 16. The frame 12 utilizes four generally upright, rectangular cross section, tubular metal posts 18, 20, 22 and 24 which are interconnected by upper side rails 26, intermediate side rails 28, and lower side rails 30, the side rails being rigidly welded between posts 20 and 22 and between posts 18 and 24. Similarly, upper rail 32, middle rail 34 and lower rail 36 are welded between posts 22 and 24 at the rear of the furnace. Front horizontal support rails 38, 40, 42 and 44 extend between upright posts 18 and 20 at the front of the furnace. Horizontal base rails 47 and 49 extend transversely between lower side rails 30. The collective posts 18, 20, 22 and 24 and the interconnecting rails 26–49 collectively comprise an upright frame for supporting the furnace described herein.

The fire box 14 is formed of sheet steel, is generally octagonal in cross section and is provided with a conventional, hinged fire box door 46 and a combustion air inlet 48. The interior of the fire box is provided with a floor of commercially available fire brick 50 on which the wood fire 52 is laid. The fire box 14 is supported on four upright tubular metal studs 54 which are rigidly welded to rails 47 and 49 and to the base of the fire box 14. The fire box is positioned within the frame 12 so as to be spaced inwardly from all of the side walls and upwardly from the rails 47 and 49 to permit free air circulation about the fire box, as will be described further hereafter. A rectangular extender 54 is welded to the front of the fire box and extends outwardly to the outer surface of the furnace housing 114. The extender is also welded to the horizontal rails 40 and 42 and provides a means of offsetting the fire box door from the outer surface of the furnace to decrease the likelihood of accidental contact with the hot fire box door.

The heat exchanger 16 is preferably hexagonal in cross section and is provided with an internal chamber 56. The exchanger has a generally flat top 58 and bottom 60 which are interconnected by generally vertical side walls 62 and 64 and downwardly, inwardly angled side walls 66 and 68. The side walls 62–68 are rigidly welded to one another as shown in FIG. 1 and are welded to front end wall 70 and rear end wall 72.

The bottom 60 of the heat exchanger 16 is provided with circular apertures 74 and 76 which communicate with upright columns 78 and 80, respectively. The columns 78 and 80 are formed of rigid sheet steel and are of generally round cross section with their upper and lower ends being welded to the heat exchanger and the fire box, respectively. These columns 78 and 80 provide a means for connecting the fire box and the heat exchanger and directing smoke from the fire box upwardly into the heat exchanger chamber, as will be described further hereafter.

A chimney stack 82 extends downwardly through an aperture in the top 58 of the exchanger and is rigidly welded to the top. The stack 82 extends downwardly within the heat exchanger chamber 56 substantially halfway between the top and bottom of the chamber so that heated air and smoke within the chamber 56 must linger adjacent the top of the chamber before eventually entering the lower, open end of the chimney stack 82 and being exhausted from the furnace 10. This increased time delay, during which the heated smoke is retained within the exchanger, allows additional heat transfer to occur from the smoke to the exchanger.

Positioned wholly within the closed exchanger chamber 56 is a rigid, metal scraper blade 84 which is slidable between the rear wall 72 and the front wall 70 of the exchanger. The blade 84 is shaped to be closely similar to the inner periphery of the heat exchanger and has a lower edge 86 which is arranged to scrape the bottom 60 of the exchanger and, similarly, has lateral edges 88 and 90 which scrape side walls 68 and 64, respectively. Similarly, edges 92 and 94 are closely adjacent side walls 66 and 62, respectively, to scrape against those side walls during movement of the blade 84. Upper edge 96 is positioned closely adjacent the top 58 to remove creosote deposits from the top of the exchanger. A rectangular groove 98 is cut in the blade 84 and is sized to accommodate the cross section of chimney stack 82 to allow the scraper to pass by the chimney 82 without contacting or damaging the chimney.

First and second, generally parallel, spaced apart rigid metal rods 100 and 102 have one end of each rod rigidly fixed to the scraper blade 84 with the remaining end of each rod being passed slidably outwardly through apertures 104 and 106 in end wall 70 and through communicating apertures in housing 114. A handle 108 interconnects the ends of rods 100 and 102. Accordingly, the rods 100 and 102, and handle 108, define a means for mounting the blade 84 for movement between a forward position 110 adjacent front end wall 70 and a rearward position 112 adjacent rear wall 72 to allow an operator to slide the blade along the inner periphery of the chamber 56 to thereby rub off and dislodge accumulated creosote deposits which would otherwise insulate the interior of the heat exchanger from the heat from fire box 14 and eventually pose a potential fire hazard.

After installation of the fire box and the heat exchanger within the framework as shown, an insulative housing 114 is attached to the framework and defines an interior air plenum 116 within the insulative housing and surrounding the fire box and heat exchanger. Apertures are provided in the insulative housing to permit the upward passage of chimney stack 82 and sliding motion of rods 100 and 102 through the housing. It has been found desirable to form the housing of inner and outer layers 120 and 118, respectively, of sheet steel with an intermediate layer of insulation 122 positioned therebetween. Preferably, a layer of pyrex paper is positioned between the insulation 122 and inner layer 120.

A chimney extension 124 is attached to the upwardly extending chimney stack 82 and is surrounded by an outer chimney housing 126 which is fixed to the top of the stove housing 114.

Positioned outside the rear insulative wall of the furnace is a blower housing 128 which contains air blower 130 which is mechanically coupled to electric motor 132 for rotation of the blower. A cold air inlet duct 134 extends upwardly from the blower housing to a cold air inlet 136 which interconnects the ducts with plenum 116 to deliver cold air from the blower 130 to the plenum for heating.

A hot air outlet 138 is located in the rear wall of the furnace adjacent the bottom of the plenum and communicates with hot air duct 140 which is connected with the house or trailer to be heated, or to the duct system in such house or trailer, for delivery of the hot air to the house. Similarly, the cold air duct 142 connects with the cold air return in the house or trailer.

A thermostat 144 is positioned on the rear wall of the furnace and has a sensing element 146 which extends inwardly toward the heat exchanger to sense the temperature level in the plenum 116. The thermostat is electrically connected between the blower motor 132 and a source of electrical energy to actuate the blower motor when the temperature within the plenum reaches an appropriate operating temperature, such as approximately 140° F. and to turn off the electric current to the motor when the temperature drops to approximately 90° F.

In operation, an operator builds a fire 52 within the fire box 14, permitting the hot smoke 159 to rise upwardly through columns 78 and 80 and into the heat exchanger 14. Hot air entering the heat exchanger moves upwardly adjacent the top 58 of the heat exchanger and is prevented from immediate exhausting into the chimney stack 82 by the chimney stack having its lower end extending downwardly within the chamber 56. Accordingly, additional heat transfer occurs within the heat exchanger 16 thereby providing better utilization of the hot smoke. Eventually, the hot smoke drops downwardly as it cools and exhausts through the chimney stack as shown by the arrows 150 in FIG. 2.

As the smoke within heat exchanger 16 cools, creosote is deposited on the side walls, end walls and top and bottom of the heat exchanger chamber and eventually would build up to levels which would require purging. To eliminate such depositing on the top, bottom and side walls, the operator slides the scraper blade 84 between front and rear positions 110 and 112 by manipulating handle 108 in directions 148 and 149 thereby causing the creosote to be scraped from the described surfaces and to drop downwardly within the heat exchanger. The vertical side walls 62 and 64 and the angled side walls 66 and 68 collectively direct the creosote downwardly to the bottom 60 of the heat exchanger when the movement of blade 84 causes the deposits to drop downwardly through columns 78 and 80 for reburning within the fire box 14.

As the temperature within the plenum 116 reaches the predetermined minimum temperature, the thermostat 144 turns to an "on" condition and energizes the blower motor 132 to cause cold air to be delivered through cold air inlet 136 to the plenum. Air circulates through the plenum and around and between the fire box and heat exchanger to become warmed, after which the heated air is withdrawn through hot air outlet 138 and conducted to the house for utilization along hot air duct 140.

Accordingly, the invention provides a wood burning furnace which has high efficiency, is easily cleaned, and is inexpensively constructed to thereby provide better heating and utilize available supplies of firewood.

While the preferred embodiment of the present invention has been described, it should be understood that various changes, adaptions and modifications may be made therein without departing from the spirit of the invention and the scope of the appended claims.

What is claimed is:

1. An improved furnace for burning wood and which is resistant to creosote deposits from smoke comprising:

an upright frame;

a fire box carried by said frame and having a door for the insertion of the wood;

a heat exchanger carried on said fire box and having an interior chamber with a top and bottom;

means connecting said fire box and said heat exchanger and directing smoke from said fire box into said exchanger chamber;

a chimney stack fixed to and extending upwardly from said exchanger to discharge smoke, said stack also extending substantially downwardly within said exchanger chamber to receive smoke from adjacent the bottom of said chamber to thereby retain hot smoke adjacent the top of said exchanger for an increased time interval to allow additional heat transfer from the smoke to said exchanger;

an insulative housing carried on said frame to define an air plenum within said housing and about said fire box and exchanger to permit air in said plenum to be heated by contact with said fire box and said exchanger; and an air inlet for cold air to enter said plenum and an air outlet by which heated air may leave said plenum.

2. The furnace of claim 1 wherein said chimney stack extends substantially half the distance between said top and said bottom of said chamber.

3. The furnace of claim 1 wherein said exchanger chamber is a closed container and comprises:

a front wall connected with said top and bottom;

a rear wall connected with said top and bottom;

at least two side walls connected with said top and said bottom and said front and rear ends;

a scraper blade slidably mounted within said heat exchanger chamber; and means mounting said blade for movement between said front wall and said rear wall of said exchanger to scrape accumulated creosote deposits from said bottom and walls of said exchanger.

4. The furnace of claim 3 wherein said connecting means includes a pair of smoke conducting columns extending downwardly from said bottom of said exchanger chamber to said fire box to direct smoke from said fire box to said exchanger and to receive creosote scraped from said walls and bottom of said exchanger and conduct such creosote into said fire box for burning.

5. The furnace of claim 4 wherein said exchanger chamber further includes a pair of angled walls with said side walls being vertical and two angled walls joining said vertical side walls and being angled toward one another and joining said bottom of said exchanger so as to guide dislodged creosote along said angled walls to said bottom to allow the creosote to be urged into said columns by said scraper blade.

6. The furnace of claim 5 wherein said means for moving said scraper blade includes:

a first rod fixed to said blade and extending forwardly therefrom; and said exchanger front wall and said housing having communicating apertures to receive said first rod therethrough so that an operator may grasp and manipulate said first rod to thereby move said scraper blade between said front and rear walls of said exchanger to scrape creosote from said bottom and said walls.

7. The furnace of claim 6 wherein:

said means for moving said scraper further includes a second rod parallel to said first rod, fixed to and extending forwardly from said scraper and further includes communicating apertures in said front wall and housing to receive said second rod; and a handle outside said insulative housing and connecting said first and second rods to be grasped by an operator for moving of said scraper blade.

8. The furnace of claim 4 wherein said blade extends to said top of said exchanger and includes a vertical slot larger than said chimney stack extending into said chamber to permit free movement of said scraper blade between front and rear walls of said exchanger while avoiding contact with said stack.

9. An improved furnace for burning wood and resistant to creosote deposits from its smoke comprising:

an upright frame;

a fire box carried by said frame and having a door for the insertion of the wood;

a heat exchanger carried on said fire box and having an interior chamber with a top and a bottom;

means connecting said fire box and said heat exchanger and directing smoke from said fire box into said heat exchanger chamber;

said heat exchanger further including a front wall, rear wall and at least two side walls;

a scraper blade slidably mounted within said heat exchanger chamber;

means mounting said blade for movement between said front and said rear walls of said heat exchanger to move said scraper blade to dislodge creosote from said walls and bottom and drop such creosote into said connecting means;

an insulative housing carried on said frame to define an air plenum within said housing to heat air; and inlet means and outlet means to respectively receive cold air into said plenum and to discharge hot air from said plenum.

* * * * *